US012584361B1

(12) United States Patent
Bolen

(10) Patent No.: US 12,584,361 B1
(45) Date of Patent: Mar. 24, 2026

(54) COILED TUBING UNITS AND SYSTEMS FOR SUBTERRANEAN WELLBORE OPERATIONS

(71) Applicant: Chevron U.S.A. Inc., San Ramon, CA (US)

(72) Inventor: Matthew Scott Bolen, The Woodlands, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 19/186,696

(22) Filed: Apr. 23, 2025

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 4,148,445 A * 4/1979 Reynolds ..... B65H 75/4407 242/397.2
5,575,332 A * 11/1996 Wasterval, Jr. ..... E21B 19/22 166/85.1
6,672,371 B1 * 1/2004 Amerman ..... E21B 33/13 166/57
7,798,237 B2 * 9/2010 Korach ..... E21B 19/22 166/77.2
2006/0254781 A1 * 11/2006 Hill ..... B65H 75/4402 166/77.2
2006/0283605 A1 * 12/2006 Wood ..... E21B 19/22 166/380
2014/0034887 A1 * 2/2014 Fetters, III ..... B66D 1/82 254/266
2016/0362950 A1 * 12/2016 Broussard ..... B65H 75/425
2018/0044995 A1 * 2/2018 Braniff ..... E21B 15/003
2021/0215004 A1 * 7/2021 Bolen ..... E21B 15/003
2021/0254412 A1 * 8/2021 Quero ..... E21B 17/20
2022/0003057 A1 * 1/2022 Plano ..... E21B 3/022
2025/0122776 A1 * 4/2025 Smith ..... E21B 19/22

* cited by examiner

*Primary Examiner* — Giovanna Wright
(74) *Attorney, Agent, or Firm* — Smith & Woklesenbet Law Group, PLLC

(57) ABSTRACT

A coiled tubing unit (CTU) for performing subterranean wellbore operations can include a base and a first tubing reel positioned on a first portion of the base, where the first tubing reel includes a first spool and a first coiled tubing, and where the first spool is configured to rotate in order to move the first coiled tubing within a wellbore within a subterranean formation. The CTU can also include a second tubing reel positioned on a second portion of the base, where the second tubing reel includes a second spool and a second coiled tubing, and where the second spool is configured to rotate in order to move the second coiled tubing within the subterranean formation. The first tubing reel and the second tubing reel may be configured to be operated simultaneously and independently of each other.

20 Claims, 6 Drawing Sheets

COILED TUBING UNITS AND SYSTEMS FOR SUBTERRANEAN WELLBORE OPERATIONS

TECHNICAL FIELD

The present application is related to wellbore operations and, more particularly, to coiled tubing units with multiple tubing reels and associated systems for subterranean wellbore operations.

BACKGROUND

Currently, when two adjacent wellbores undergo coiled tubing drill outs at the same time, two separate coiled tubing units (CTUs) must be deployed, one for each wellbore. This arrangement requires multiple cranes, extra equipment and fuel for providing power, hydraulics, and fluid to each CTU, and separate manpower in order to safely operate for each CTU.

SUMMARY

In general, in one aspect, the disclosure relates to a CTU for performing subterranean wellbore operations. The CTU may include a base and a first tubing reel positioned on a first portion of the base, where the first tubing reel includes a first spool and a first coiled tubing, and where the first spool is configured to rotate in order to move the first coiled tubing within a wellbore within a subterranean formation. The CTU may also include a second tubing reel positioned on a second portion of the base, where the second tubing reel includes a second spool and a second coiled tubing, and where the second spool is configured to rotate in order to move the second coiled tubing within the subterranean formation. The first tubing reel and the second tubing reel may be configured to be operated simultaneously and independently of each other.

In another aspect, the disclosure relates to a coiled tubing system that includes a CTU positioned proximate to a first wellbore and a second wellbore. The CTU of the coiled tubing system may include a base and a first tubing reel positioned on a first portion of the base, where the first tubing reel includes a first spool and a first coiled tubing, and where the first spool is configured to rotate in order to move the first coiled tubing within a first wellbore within a subterranean formation. The CTU of the coiled tubing system may also include a second tubing reel positioned on a second portion of the base, where the second tubing reel includes a second spool and a second coiled tubing, where the second spool is configured to rotate in order to move the second coiled tubing within a second wellbore within the subterranean formation, and where the first tubing reel and the second tubing reel are configured to be operated simultaneously and independently of each other. The coiled tubing system may also include a first guide arch mounted adjacent to the base and the first reel, where the first guide arch is configured to feed the first coiled tubing between the first reel and the first wellbore. The coiled tubing system may further include a second guide arch mounted adjacent to the base and the second reel, where the second guide arch is configured to feed the second coiled tubing between the second reel and the second wellbore.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
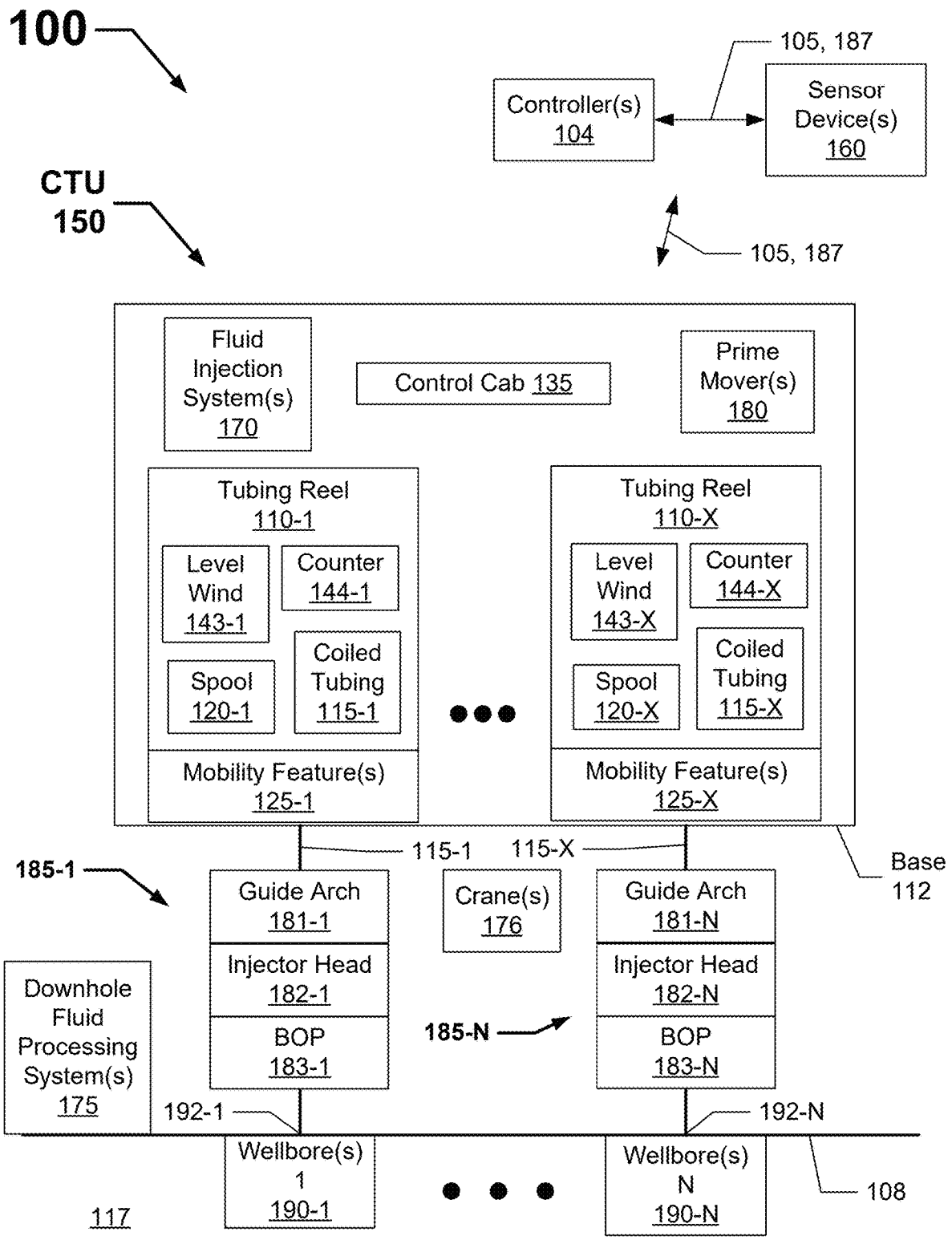
FIG. 1 shows a general system for performing subterranean wellbore operations using a CTU according to certain example embodiments.

The example embodiments discussed herein are directed to systems, methods, and devices for CTUs and systems used for subterranean wellbore operations. Subterranean wellbore operations for which example embodiments may be used can include, but are not limited to, drilling, fishing, clearing obstructions, producing subterranean resources, setting tools, circulating fluids, setting bridge plugs, and setting packers. Examples of a subterranean resource can include, but are not limited to, natural gas, oil, and water. Wellbores for which example embodiments are used for subterranean wellbore operations can be land-based or subsea. Example embodiments may be used for wellbores drilled in conventional and/or unconventional (e.g., tight shale) subterranean formations and reservoirs. Example embodiments of CTUs and systems used for subterranean wellbore operations can be rated for use in hazardous environments.

As defined herein, a user is any person or entity that is involved with subterranean wellbore operations. Examples of a user may include, but is not limited to, a driller, an engineer, a consultant, a field hand, a mechanic, an electrician, a technician, a company representative, and a regulatory authority. The terms "formation", "subsurface formation", "hydrocarbon-bearing formation", "reservoir", "subsurface reservoir", "subsurface area of interest", "subsurface region of interest", "subsurface volume of interest", and the like may be used synonymously. The term "subterranean formation" is not limited to any description or configuration described herein.

A "subterranean formation" refers to practically any volume under a surface. For example, it may be practically any volume under a terrestrial surface (e.g., a land surface), practically any volume under a seafloor, etc. Each subsurface volume of interest may have a variety of characteristics, such as petrophysical rock properties, reservoir fluid properties, reservoir conditions, hydrocarbon properties, or any combination thereof. For example, each subsurface volume of interest may be associated with one or more of: temperature, porosity, salinity, permeability, water composition, mineralogy, hydrocarbon type, hydrocarbon quantity, reservoir location, pressure, etc. Those of ordinary skill in the art will appreciate that the characteristics are many, including, but not limited to: shale gas, shale oil, tight gas, tight oil, tight carbonate, carbonate, vuggy carbonate, unconventional formation (e.g., a permeability of less than 25 millidarcy (mD) such as a permeability of from 0.000001 mD to 25 mD)), diatomite, geothermal, mineral, etc.

The use of the terms "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of ±10 percent of the given numeric value provided such a deviation does not alter the end function or result of the value. Therefore, a value of about 1% may be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

A "well" or a "wellbore" refers to a single hole, usually cylindrical, that is drilled into a subsurface volume of interest. A well or a wellbore may be drilled in one or more directions. For example, a well or a wellbore may include a vertical well, a horizontal well, a deviated well, and/or other type of well. A well or a wellbore may be drilled in the subterranean formation for exploration and/or recovery of resources. A plurality of wells (e.g., tens to hundreds of wells) or a plurality of wellbores are often used in a field depending on the desired outcome.

A well or a wellbore may be drilled into a subsurface volume of interest using practically any drilling technique and equipment known in the art, such as geosteering, directional drilling, etc. Drilling the well may include using a tool, such as a drilling tool that includes a drill bit and a drill string. Drilling fluid, such as drilling mud, may be used while drilling in order to cool the drill tool and remove cuttings. Other tools may also be used while drilling or after drilling, such as measurement-while-drilling (MWD) tools, seismic-while-drilling tools, wireline tools, logging-while-drilling (LWD) tools, or other downhole tools. After drilling to a predetermined depth, the drill string and the drill bit may be removed, and then the casing, the tubing, and/or other equipment may be installed according to the design of the well. The equipment to be used in drilling the well may be dependent on the design of the well, the subterranean formation, the hydrocarbons, and/or other factors.

A well may include a plurality of components, such as, but not limited to, a casing, a liner, a tubing string, a sensor, a packer, a screen, a gravel pack, artificial lift equipment (e.g., an electric submersible pump (ESP)), and/or other components. If a well is drilled offshore, the well may include one or more of the previous components plus other offshore components, such as a riser. A well may also include equipment to control fluid flow into the well, control fluid flow out of the well, or any combination thereof. For example, a well may include a wellhead, a choke, a valve, and/or other control devices. These control devices may be located on the surface, in the subsurface (e.g., downhole in the well), or any combination thereof.

In some embodiments, the same control devices may be used to control fluid flow into and out of the well. In some embodiments, different control devices may be used to control fluid flow into and out of a well. In some embodiments, the rate of flow of fluids through the well may depend on the fluid handling capacities of the surface facility that is in fluidic communication with the well. The equipment to be used in controlling fluid flow into and out of a well may be dependent on the well, the subsurface region, the surface facility, and/or other factors. Moreover, sand control equipment and/or sand monitoring equipment may also be installed (e.g., downhole and/or on the surface). A well may also include any completion hardware that is not discussed separately. The term "well" may be used synonymously with the terms "borehole," "wellbore," or "well bore." The term "well" is not limited to any description or configuration described herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A.

In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C.

In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C).

In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

An example CTU and system used for subterranean wellbore operations can be designed to comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Also, as discussed above, an example CTU and system used for subterranean wellbore operations can be used in hazardous environments, and so example system used for subterranean wellbore operations can be designed to comply with industry standards that apply to hazardous environments.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of CTU s and systems for subterranean wellbore operations will be described more fully hereinafter with reference to the accompanying drawings, in which example embodiments of CTUs and systems for subterranean wellbore operations are shown. CTUs and systems used for subterranean wellbore operations may, however, be embodied in many different forms and should not be construed as limited to the example embodiments set forth herein. Rather, these example embodiments are provided so that this disclosure will be thorough and complete, and will fully convey the scope of CTU sand systems used for subterranean wellbore operations to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "left", "right", "front", "rear", and "within", when present, are used merely to distinguish one component (or part of a component or state of a component) from another. This list of terms is not exclusive. Such terms are not meant to denote a preference or a particular orientation, and they are not meant to limit embodiments of CTUs and systems used for subterranean wellbore operations. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a general system 100 for performing subterranean wellbore operations using a CTU according to certain example embodiments. The system 100 includes multiple components. In this case, the system 100 includes a CTU 150, one or more arch guides 181, one or more injector heads 182, one or more blow out preventers (BOPs) 183, one or more cranes 176, one or more downhole fluid processing systems 175, one or more wellbores 190 (e.g., wellbore 190-1 through wellbore 190-N), one or more sensor devices 160, and a controller 104. The example CTU 150 may include multiple components.

In this case, the CTU 150 includes multiple tubing reels 110 (tubing reel 110-1 through tubing reel 110-X), a control cab 135, one or more fluid injection systems 170, and one or more prime movers 180. Each tubing reel 110 may include multiple components. In this case, each tubing reel 110 may include a spool 120, a coiled tubing 115, a level wind 143, a counter 144, and one or more mobility features 125. For example, tubing reel 110-1 includes a spool 120-1, a coiled tubing 115-1, a level wind 143-1, a counter 144-1, and one or more mobility features 125-1. As another example, tubing reel 110-X includes a spool 120-X, a coiled tubing 115-X, a level wind 143-X, a counter 144-X, and one or more mobility features 125-X.

The components shown in FIG. 1 are not exhaustive, and in some embodiments, one or more of the components shown in FIG. 1 may not be included in the example system 100. For example, while one CTU 150 is shown in FIG. 1, the system 100 may include multiple CTUs 150, where one CTU 150 may be configured the same as, or different than, one or more of the other CTU s 150 in the system 100. Any component of the system 100 can be discrete or combined with one or more other components of the system 100. A Iso, one or more components of the system 100 can have different configurations. For example, one or more sensor devices 160 can be disposed within or disposed on other components (e.g., a prime mover 180, a fluid injection system 170). A s another example, the controller 104, rather than being a stand-alone device, can be part of another component (e.g., a fluid injection system 170) of the system 100. As yet another example, the system 100 (or portion thereof, such as the CTU 150) can include a number of cables (e.g., electrical cables, hydraulic cables) and/or lines (e.g., fluid lines), which are not shown in FIG. 1 to simplify the drawing. As still another example, the system 100 can include a downhole fluid processing system and/or associated units, which are not shown in FIG. 1 to simplify the drawing.

The example CTU 150 is used during subterranean wellbore operations, which may include drilling operations, completion operations, workover operations, and/or remediation operations. As discussed above, in the current art, a CTU only has a single tubing reel, and the tubing reel in the current art does not include mobility features, such as the mobility features 125 discussed below. This limits what may be accomplished by a CTU in the current art without replacing the CTU with another CTU, which costs time and resources. The CTU 150 has a base 112 upon which all of the other components of the CTU 150 are directly or indirectly mounted and/or to which one or more of the other components of the CTU 150 are directly or indirectly coupled.

The base 112 may be planar and/or have some three-dimensional features (e.g., steps, ramps). The base 112 may have any of a number of suitable features (e.g., treads on the top surface, coupling features (e.g., holes, hooks), doors, panels) to facilitate the operation of the other components of the CTU 150. The base 112 may be made of one or more of a number of suitable materials, including but not limited to metal (e.g., stainless steel), plastic, rubber, ceramics, and glass. In some cases, the base 112 of the CTU 150 is or is part of or is placed atop a trailer for a semi-truck. In such cases, the CTU 150 may be transported to, from, and/or around a job site (e.g., where the wellbores 190 are located) using a semi-truck or similar vehicle that can move a wheeled trailer. Alternatively, in some cases, the base 112 of the CTU 150 is or is part of a skid that rests on the surface 108 (e.g., the ground). In such cases, the CTU 150 may be moved around a job site by a crane 176 (e.g., using lifting aids 314 discussed below with respect to FIGS. 3A and 3B), a fork lift, and/or some other machine. The various components (e.g., the tubing reels 110, the prime movers 180) of the CTU 150 are configured to be operated while on the base 112, regardless of whether the base 112 is on (or is part of) a trailer or a skid. The CTU 150 may be positioned directly on the surface 108 or elevated above the surface 108 (e.g., by tires on a tailer). While not shown in FIG. 1, the CTU 150 is often at a lower elevation relative to the surface 108 compared to the guide arches 181.

Each fluid injection system 170 of the example CTU 150 may be configured to provide a fluid (e.g., drilling fluid, workover fluid) to the coiled tubing 115 of one or more of the tubing reels 110 of the CTU 150. In such a case, the fluid flows through the coiled tubing 115 and into a wellbore 190. When a CTU 150 is servicing multiple wellbores 190 simultaneously, one portion of the fluid injection system 170 may provide a fluid to the coiled tubing 115 of one of the tubing reels 110 of the CTU 150, while one or more other portions of the fluid injection system 170 may provide the same fluid or a different fluid to the coiled tubing 115 of one or more of the other tubing reels 110 of the CTU 150. Alternatively, when a CTU 150 is servicing multiple wellbores 190 simultaneously, one fluid injection system 170 of the CTU 150 may provide a fluid to the coiled tubing 115 of one of the tubing reels 110 of the CTU 150, while another fluid injection system 170 of the CTU 150 may provide the same fluid or a different fluid to the coiled tubing 115 of one or more of the other tubing reels 110 of the CTU 150.

A fluid injection system 170 may also prepare (e.g., mix, heat, agitate) the fluid that is provided to the coiled tubing 115. A fluid injection system 170 may include one or more of a number of different pieces of equipment and/or components. Examples of such pieces of equipment and components of a fluid injection system 170 may include, but are not limited to, a motor, a pump, a mixer, a vessel, a centrifuge, piping, a swivel joint, a controller 104, a sensor device 160, a valve, a meter, a compressor, a heater, a fan, a heat exchanger, and a blower. Each piece of equipment and component of a fluid injection system 170 may be mounted, directly or indirectly, on the base 112 of the CTU 150.

Each prime mover 180 of the example CTU 150 may provide power and/or hydraulics to one or more of the tubing reels 110, one or more other components (e.g., the control cab 135, a fluid injection system 170, a mobility feature 125, a spool 120) of the CTU 150, and/or other components (e.g., a downhole fluid processing system) of the system 100. A prime mover 180 may include one or more of a number of different pieces of equipment and/or components. Examples of such pieces of equipment and components of a prime mover 180 may include, but are not limited to, a motor, a pump, a diesel generator, a natural gas-fired generator, hydraulic line, electrical cable, a controller 104, a sensor device 160, a meter, a protective relay, a compressor, a fan, a heat exchanger, a transformer, a circuit breaker, a contactor, a capacitor, a resistor, a transistor, an inverter, and a converter. Each piece of equipment and component of a prime mover 180 may be mounted, directly or indirectly, on the base 112 of the CTU 150.

The control cab 135 of the example CTU 150 is a housing (e.g., a shed, a trailer) or other space that is mounted, directly or indirectly, on the base 112 of the CTU 150. The control cab 135 allows a user to control operation of one or more other components (including portions thereof) of the CTU 150 (e.g., a tubing reel 110, a prime mover 180, a fluid injection system 170) at a point in time. The control cab 135 may include one or more of a number of interfaces and/or information sources that are accessible to a user within that space. Examples of such interfaces and information sources may include, but are not limited to, switches, gauges, pushbuttons, meters, displays, speakers, panels, and indicating lights. The control cab 135 may be referred to by any of a number of other names, including but not limited to a control cabinet, a control room, and a control trailer. The control cab 135 may be mounted, directly or indirectly, on the base 112 of the CTU 150.

A spool 120 of a tubing reel 110 of a CTU 150 is a cylindrical device around which the coiled tubing 115 is wound and unwound as the coiled tubing 115 is inserted into and withdrawn from a wellbore 190. Each spool 120 is configured to rotate in either direction about an axis that traverses its middle along its width. A spool 120 can include a mounting apparatus that suspends the spool 120 above the base 112 and allows the spool 120 to freely rotate (subject to locking mechanisms and the like that are part of the mounting apparatus). A spool 120 (e.g., spool 120-1, spool 120-X) is configured to rotate about its horizontal axis along its length in order to move the associated coiled tubing 115 (e.g., coiled tubing 115-1, coiled tubing 115-X) within a wellbore 190 in the subterranean formation 117. The mounting apparatus of a spool 120 may be made of a single component or multiple components. The configuration (e.g., size, mounting apparatus, material) of one spool 120 (e.g., spool 120-1) may be the same as, or different than, the configuration of one or more of the other spools 120 (e.g., spool 120-X) of the CTU 150.

The mounting apparatus of the spool 120 may be coupled to and/or integrated with one or more of the mobility features 125 of the tubing reel 110. A mobility feature 125 allows for movement of the mounting apparatus of a spool 120 (and so also the spool 120 itself) to move relative to the base 112 aside from the winding and unwinding of the coiled tubing 115 with respect to the spool 120. Put another way, a mobility feature 125 allows a tubing reel 110 to be moveably coupled to the base 112. For example, a mobility feature 125 may be or include a swivel mounted on the base 112 on which the mounting apparatus of a spool 120 is mounted. In such a case, the mounting apparatus of the spool 120 (and so also the spool 120) is rotatable about a vertical axis with respect to the base 112.

As another example, one mobility feature 125 may be or include a track or rail that is mounted on the base 112, and another mobility feature 125 may be a number of wheels mounted on the bottom surface of the mounting apparatus of the spool 120. In such a case, the mounting apparatus of the spool 120 (and so also the spool 120) is slidable along the track or rail with respect to the base 112. In certain example embodiments, a mobility feature 125 of a tubing reel 110 includes a securing mechanism (e.g., a clamp, a pin, a bolt, a screw, a stop, a lock, a chuck) that secures the position of the mounting apparatus of a spool 120 (and so also the spool 120) in a fixed position (not counting the rotational movement of the spool 120 relative to the mounting apparatus of the spool 120) relative to the base 112.

A mobility feature 125 may have any of a number of components and/or configurations. The configuration of the mobility feature 125 (e.g., mobility features 125-1) of one tubing reel 110 (e.g., tubing reel 110-1) may be the same as, or different than, the configuration of the other mobility feature 125 (e.g., mobility feature 125-X) of one or more of the other tubing reels 110 (e.g., tubing reel 110-X). In some cases, a mobility feature 125 (e.g., in the form of a rail mounted on the base 112) may be shared in part with a mobility feature 125 of multiple tubing reels 110 of the CTU 150.

The coiled tubing 115 of a tubing reel 110 is a long flexible pipe (usually made of metal). The coiled tubing 115 may have a diameter (e.g., 0.75 inches, 1 inch, 2 inches, 3 inches, 4.5 inches) and a length (e.g., 2000 feet, 10000 feet, 20000 feet, 30000 feet). The coiled tubing 115 has a cavity along its length that allows a fluid (provided by a fluid injection system 170) to flow therethrough. The coiled tubing 115 may be rigid enough to perform whatever subterranean operation (e.g., drilling, fishing, logging, clearing obstructions, producing subterranean resources, perforating, setting tools, circulating fluids (e.g., for well treatment), setting bridge plugs, setting packers) is being performed within a particular wellbore 190. The characteristics (e.g., diameter, length, material) of the coiled tubing 115 of one tubing reel 110 of the CTU 150 may be the same as, or different than, the corresponding characteristics of the coiled tubing 115 of one or more of the other tubing reels 110 of the CTU 150.

The counter 144 of a tubing reel 110 is configured to measure the length of the coiled tubing 115 that is unwound (in this case, inserted into a wellbore 190) from the spool 120 of the tubing reel 110 and/or wound back on the spool 120 of the tubing reel 110. The counter 144 may have any of a number of configurations and/or use any type of technology known in the industry. The counter 144 may be or include one or more sensor devices 160. The counter 144 may track a length of the coiled tubing 115 in real time, periodically (e.g., every minute, every hour, every hundred feet), randomly, and/or on some other basis. The count tracked by the counter 144 may be provided to a controller 104, which may process the data and/or use the data in an algorithm and/or protocol. The count tracked by the counter 144 may additionally or alternatively be provided to a user (e.g., in the control cab 135). The configuration of the counter 144 (e.g., counter 144-1) of one tubing reel 110 may be the same as, or different than, the configuration of the counter 144 (e.g., counter 144-X) of one or more of the other tubing reels 110 of the CTU 150.

The level wind 143 of a tubing reel 110 is a mechanism that is configured to ensure an even distribution of the coiled tubing 115 as the coiled tubing 115 is wound back on the spool 120. This prevents kinking, tangling, and/or other issues that may arise when the coiled tubing 115 is unwound from the spool 120 at a subsequent time. In some cases, the level wind 143 may also help to ensure that the coiled tubing 115 is fed smoothly between the spool 120 and the guide arch 181, discussed below. The level wind 143 can have any of a number of components and/or configurations known in the art. The components and/or configuration of the level wind 143 (e.g., level wind 143-1) of one tubing reel 110 may be the same as, or different than, the components and/or configuration of the level wind 143 (e.g., level wind 143-X) of one or more of the other tubing reels 110 of the CTU 150. The level wind 143-1 and the counter 144-1 may be configured to assist winding and unwinding the coiled tubing 115-1 with respect to the spool 120-1. Similarly, the level wind 143-X and the counter 144-X may be configured to assist winding and unwinding the coiled tubing 115-X with respect to the spool 120-X.

The system 100 can have any number (e.g., 1, 2, 3, 10, 25, 60) of wellbores 190 that are drilled into the subterranean formation 117. The subterranean formation 117 can include one or more of a number of formation types, including but not limited to shale, limestone, sandstone, clay, sand, and salt. A subterranean formation 117 can include one or more reservoirs in which one or more resources (e.g., oil, gas, water, steam) can be located. One or more of a number of field operations (e.g., fracturing, coring, tripping, drilling, setting casing, extracting downhole resources) can be performed to reach an objective of a user with respect to the subterranean formation 117.

In this case, there are N wellbores 190 (wellbore 190-1 through wellbore 190-N). The number of wellbores 190 in the system 100 may be the same as, greater than, or less than the number of tubing reels 110 on a CTU 150 and/or the number of CTUs 150. Each wellbore 190 that is undergoing subterranean wellbore operations using the CTU 150 has a guide arch 181, an injector head 182, and a BOP 183. For example, as shown in FIG. 1, wellbore 190-1 has, above the surface 108 (e.g., ground level for land-based developments, a seabed for subsea developments), a guide arch 181-1, an injector head 182-1, and a BOP 183-1. As another example, wellbore 190-N has, above the surface 108 (e.g., ground level for land-based developments, a seabed for subsea developments), a guide arch 181-N, an injector head 182-N, and a BOP 183-N. Each wellbore 190 also has an entry point 192 (e.g., entry point 192-1 for wellbore 190-1, entry point 192-N for wellbore 190-N), which is the point where the wellbore 190 begins at the surface 108. When there are multiple wellbores 190, two or more of the wellbores 190 may be drilled from the same pad and/or from different pads.

Each guide arch 181 is configured to direct coiled tubing 115 that is unwound from a spool 120 downward to the injector head 182. Conversely, each guide arch 181 is configured to direct coiled tubing 115 toward the level wind 143 and the spool 120 of a tubing reel 110 as the coiled tubing 115 is withdrawn from a wellbore 190 through the injector head 182. The guide arch 181 may be referred to by any of a number of other names in the industry, including but not limited to a gooseneck and a horsehead. The guide arch 181 is generally configured in an inverted "U" shape (to provide a controlled radius) and is made of a rigid material (e.g., metal) along which the coiled tubing 115 slides as the coiled tubing 115 is inserted into and withdrawn from the wellbore 190.

In some cases, a guide arch 181 is coupled to an adjacent injector head 182 for the wellbore 190. When the system 100 includes multiple wellbores 190 that are undergoing active field operations using the CTU 150, the system 100 includes multiple guide arches 181. In such cases, the configuration of one guide arch 181 (e.g., guide arch 181-1) in the system 100 may be the same as, or different than, the configuration of one or more of the other guide arches 181 (e.g., guide arch 181-N) in the system 100.

Each injector head 182 is configured to straighten out the coiled tubing 115 before the coiled tubing 115 enters the wellbore 190. An injector head 182 may have any of a number of different configurations using a number of different types of equipment. For example, an injector head 182 may include multiple profiled chain assemblies to grip the coiled tubing 115 and a hydraulic drive system that provides the tractive force for inserting and retrieving the coiled tubing 115 into and out of a wellbore 190. The bottom part of an injector head 182 may include a stripper assembly, which provides a dynamic seal around the coiled tubing 115. In some cases, the bottom end of an injector head 182 is coupled to the top of the BOP 183, and the top end of the injector head 182 is coupled to a guide arch 181. When the system 100 includes multiple wellbores 190 that are undergoing active field operations using the CTU 150, the system 100 includes multiple injector heads 182. In such cases, the configuration of one injector head 182 (e.g., injector head 182-1) in the system 100 may be the same as, or different than, the configuration of one or more of the other injector heads 182 (e.g., injector head 182-N) in the system 100.

Each BOP 183 is attached atop a wellhead (not shown in FIG. 1) and provides secondary and contingency pressure-control functions for the wellbore 190. A BOP 183 is a specialized valve or similar mechanical device that acts as a seal and control mechanism at the wellhead, ensuring that the wellbore 190 remains under control during drilling, completion, and other operations. BOPs 183 are well known in the industry and have a number of configurations and/or components. When the system 100 includes multiple wellbores 190 that are undergoing active field operations using the CTU 150, the system 100 includes multiple BOPs 183. In such cases, the configuration of one BOP 183 (e.g., BOP 183-1) in the system 100 may be the same as, or different than, the configuration of one or more of the other BOPs 183 (e.g., BOP 183-N) in the system 100.

Each crane 176 (sometimes more generally described herein as a lifting apparatus) of the system 100 is used to lift, put down, suspend, and/or move one or more objects and/or components of the system 100. For example, in field operations using CTUs, including the example CTU 150, a crane 176 is used to suspend the assembly 185 of a BOP 183, an injector head 182, and a guide arch 181 in place above the surface 108. For example, the assembly 185-1 includes the BOP 183-1, the injector head 182-1, and the guide arch 181-1. As another example, the assembly 185-N includes the BOP 183-N, the injector head 182-N, and the guide arch 181-N.

Figure 2:
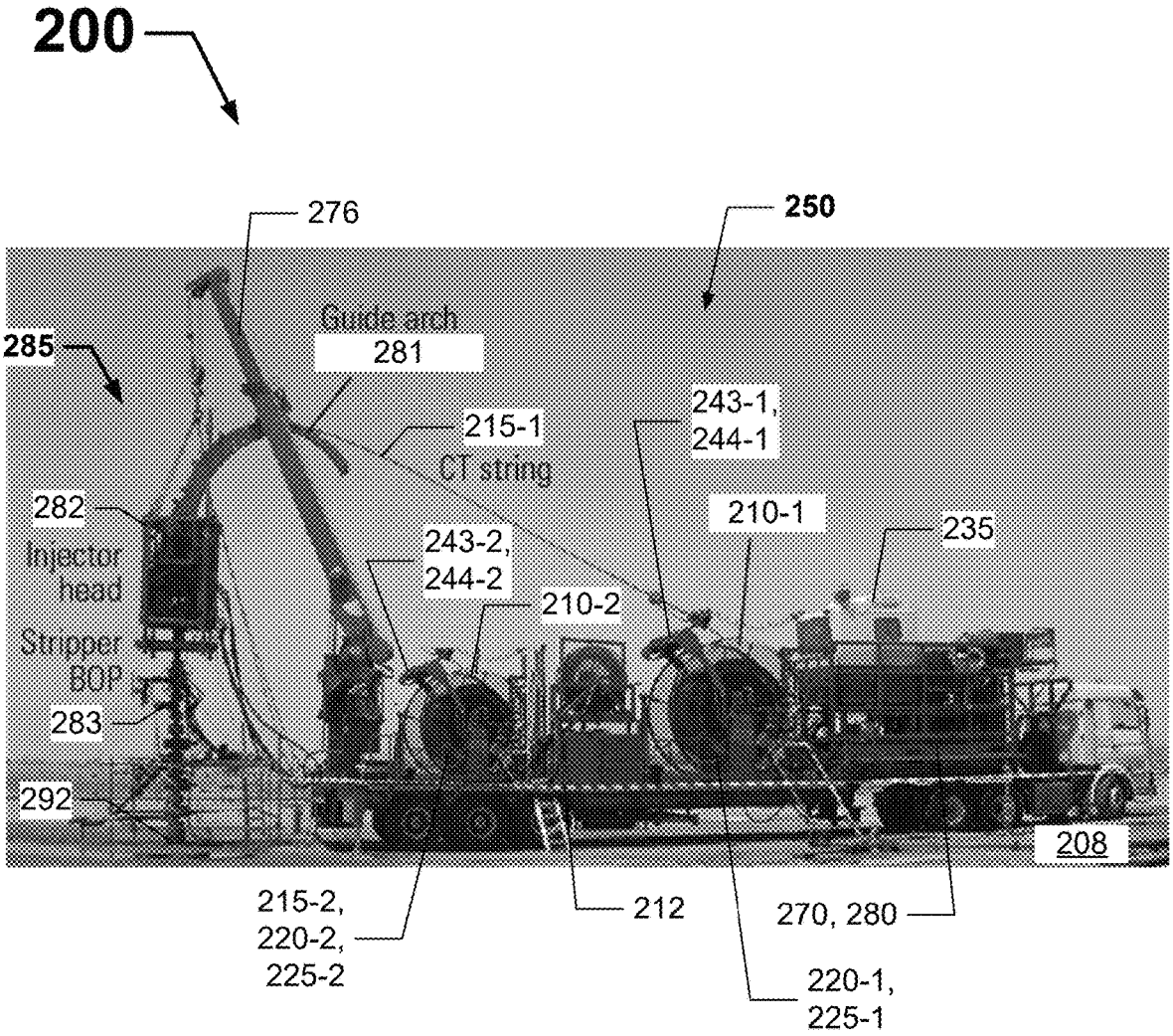
FIG. 2 shows a generated image of a system that includes an example CTU on a flatbed trailer according to certain example embodiments.

The image captured in FIG. 2 shows an example of this situation. A crane 176 can have any type of mobility features (e.g., tires, caterpillar tracks) and be of any size (e.g., in terms of reach, in terms of weight capacity) suitable for the objects and/or equipment that the crane 176 is used to lift, put down, suspend, and/or move. In the current art, when multiple wellbores 190 are subject to a subterranean field operation using multiple CTUs, a crane 176 is required to suspend an assembly 185 of a BOP 183, an injector head 182, and a guide arch 181 above the surface 108 for each wellbore 190. As discussed in more detail below with respect to FIG. 7, the configuration of example CTUs 150 discussed herein allow for fewer cranes 176 on the job site. When the system 100 includes multiple cranes 176, the configuration of one crane 176 may be the same as, or different than, the configuration of one or more of the other cranes 176 in the system 100.

Each downhole fluid processing system 175 of the system 100 may be configured to receive and process downhole fluids (e.g., formation water, subterranean resources, drilling fluid, workover fluid) that come up from one or more of the wellbores 190 during subterranean field operations. For example, a downhole fluid processing system 175 may be configured to receive and process a downhole fluid from wellbore 190-1 and simultaneously be configured to receive and process a separate downhole fluid from wellbore 190-N. A downhole fluid processing system 175 may include one or more of a number of different pieces of equipment and/or components. Examples of such pieces of equipment and components of a downhole fluid processing system 175 may include, but are not limited to, a motor, a pump, a mixer, a vessel, a centrifuge, piping, a swivel joint, a controller 104, a sensor device 160, a valve, a meter, a compressor, a heater, a fan, a heat exchanger, and a blower. Each piece of equipment and component of a downhole fluid processing system 175 may be mounted, directly or indirectly, on the base 112 of the CTU 150. In addition, or in the alternative, a piece of equipment and component of a downhole fluid processing system 175 may be controlled from the control cab 135.

The system 100 can include one or more controllers 104. A controller 104 of the system 100 communicates with and in some cases controls one or more of the other components (e.g., a sensor device 160, a fluid injection system 170, a prime mover 180, a spool 120, a mobility feature 125, a BOP 183), or portions thereof, of the system 100. A controller 104 may perform a number of functions that may include receiving data, evaluating data, following protocols, running algorithms, and sending commands. A controller 104 can include one or more of a number of components. Such components of a controller 104 can include, but are not limited to, a control engine, a communication module, a timer, a counter, a power module, a storage repository, a hardware processor, memory, a transceiver, an application interface, and a security module. When there are multiple controllers 104, each controller 104 can operate independently of each other. Alternatively, one or more of the controllers 104 can work cooperatively with each other. As yet another alternative, one of the controllers 104 can control some or all of one or more other controllers 104 in the system 100.

The system 100 may include one or more sensor devices 160. Each sensor device 160 includes one or more sensors that measure one or more parameters (e.g., pressure, flow rate, temperature, voltage, current, humidity, rotation rate, weight, magnetic field, proximity). A sensor device 160 can be integrated with or measure a parameter associated with one or more components of the system 100. For example, a sensor device 160 can be configured to measure a parameter (e.g., flow rate, pressure, temperature) of a fluid flowing through the coiled tubing 115. As another example, a sensor device 160 can be configured to determine how much power is being provided to a spool from the prime mover 180. As yet another example, a sensor device 160 can be configured to determine how open or closed a valve is. A sensor device 160 can have one or multiple sensors. In some cases, a number of sensors and/or sensor devices 160, each measuring a different parameter, can be used in combination to determine and confirm whether a controller 104 should take a particular action (e.g., operate a valve, control a pump motor).

Interaction between each controller 104, the sensor devices 160, and other components (e.g., the fluid injection systems 170, the prime movers 180, the spools 120, the mobility features 125) of the system 100 can be conducted using communication links 105 and/or power transfer links 187. Each communication link 105 can include wired (e.g., Class 1 electrical cables, Class 2 electrical cables, electrical connectors, Power Line Carrier, RS485) and/or wireless (e.g., Wi-Fi, Zigbee, visible light communication, cellular networking, Bluetooth, WirelessHART, ISA100) technology. A communication link 105 can transmit signals (e.g., communication signals, control signals, data) between each controller 104, the sensor devices 160, and other components of the system 100.

Each power transfer link 187 can include one or more electrical conductors, which can be individual or part of one or more electrical cables. In some cases, as with inductive power, power can be transferred wirelessly using power transfer links 187. A power transfer link 187 can transmit power between each controller 104, the sensor devices 160, and other components of the system 100. Each power transfer link 187 can be sized (e.g., 12 gauge, 18 gauge, 4 gauge) in a manner suitable for the amount (e.g., 480V, 24V, 120V) and type (e.g., alternating current, direct current) of power transferred therethrough.

FIG. 2 shows a generated image of a system 200 that includes an example CTU 250 on a flatbed trailer according to certain example embodiments. Referring to the description above with respect to FIG. 1, the system 200 of FIG. 2 includes an example CTU 250, a crane 276, a BOP 283, an injector head 282, and a guide arch 281. The CTU 250 includes two tubing reels 210 (tubing reel 210-1 and tubing reel 210-2), a fluid injection system 270, a prime mover 280, and a control cab 235. A II of these components are mounted, directly or indirectly, on a base 212 in the form of a flatbed of a trailer for a semi-truck.

Each tubing reel 210 of the CTU 250 includes a coiled tubing 215, a spool 220, a mobility feature 225, a level wind 243, and a counter 244. Specifically, the tubing reel 210-1 of the CTU 250 includes a coiled tubing 215-1, a spool 220-1, a mobility feature 225-1, a level wind 243-1, and a counter 244-1. A Iso, the tubing reel 210-2 of the CTU 250 includes a coiled tubing 215-2, a spool 220-2, a mobility feature 225-2, a level wind 243-2, and a counter 244-2. The various components (including portions thereof) of the system 200 of FIG. 2 are substantially the same as the corresponding components (including portions thereof) of the system 100 of FIG. 1 above.

At the time captured in FIG. 2, the example CTU 250 is being used to service a single wellbore (e.g., similar to the wellbores 190 discussed above with respect to FIG. 1). The entry point 292 of the wellbore is shown in FIG. 2. The assembly 285 of the BOP 283, the injector head 282, and the guide arch 281 is suspended above the ground 208 by the crane 276 above the entry point 292 to the wellbore. The coiled tubing 215-1 of the tubing reel 210-1 is being fed through the BOP 283 and into the wellbore using the guide arch 281 and the injector head 282. The tubing reel 210-2 is idle at the time captured in FIG. 2. In this case, a mobility feature 225-1 in the form of a swivel with a locking function is used to rotate the spool 220-1 about a vertical axis through the base 212 so that the level wind 243-1 of the tubing reel 210-1 is optimally aligned with the guide arch 281. A Iso, the spool 220-2 of the tubing reel 210-2 is smaller than the spool 220-1 of the tubing reel 210-1.

Figure 3A:
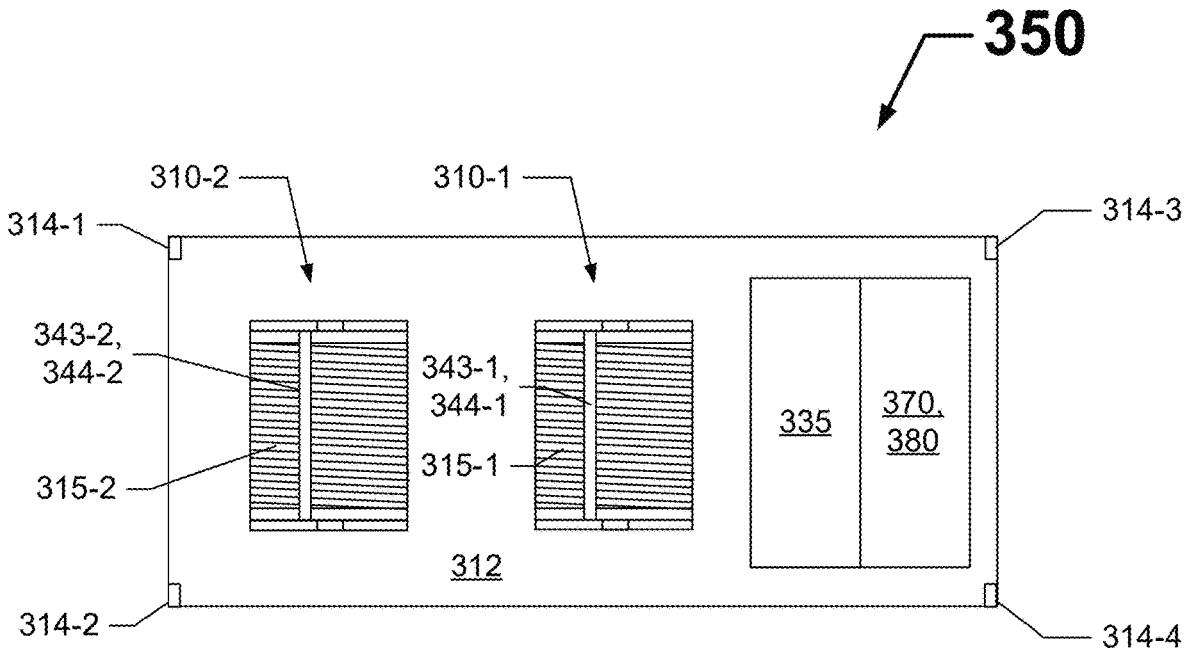
FIGS. 3A and 3B show a top and sideview, respectively, of a CTU according to certain example embodiments.
Figure 3B:
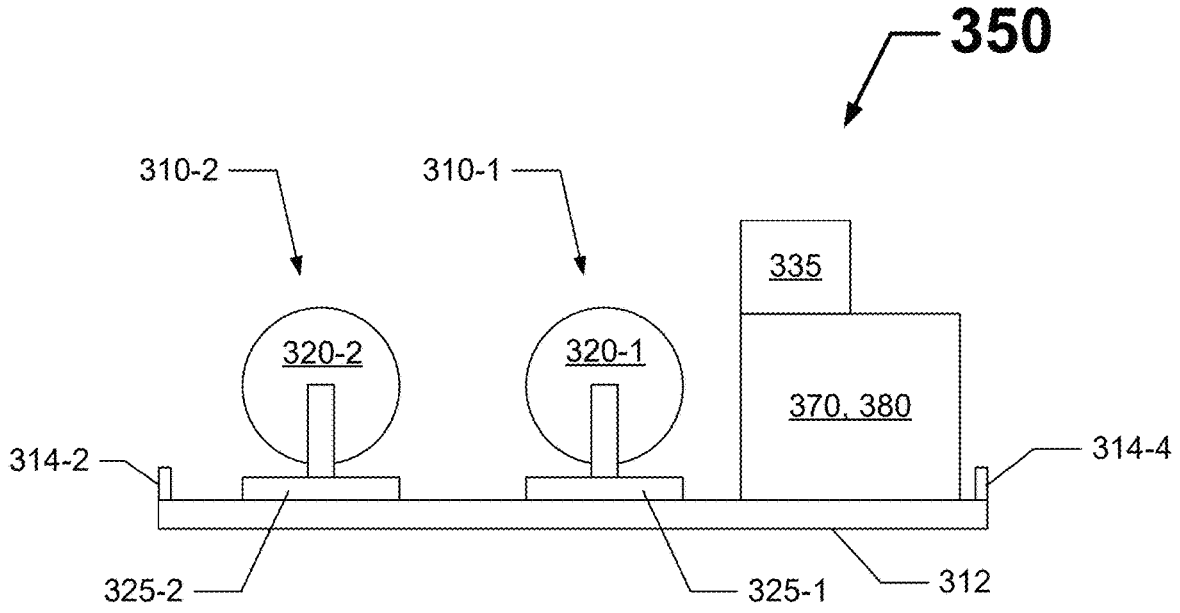

FIGS. 3A and 3B show a top and side view, respectively, of a CTU 350 according to certain example embodiments. Referring to the description above with respect to FIGS. 1 and 2, the CTU 350 of FIGS. 3A and 3B includes two tubing reels 310 (tubing reel 310-1 and tubing reel 310-2), a fluid injection system 370, a prime mover 380, and a control cab 335. All of these components are mounted, directly or indirectly, on a base 312 in the form of a skid that sits on the ground (e.g., ground 208). For example, the control cab 335 is mounted atop the fluid injection system 370 and the prime mover 380, which are mounted on the base 312.

The tubing reel 310-1 of the CTU 350 includes a coiled tubing 315-1, a spool 320-1, a mobility feature 325-1, a level wind 343-1, and a counter 344-1. A Iso, the tubing reel 310-2 of the CTU 350 includes a coiled tubing 315-2, a spool 320-2, a mobility feature 325-2, a level wind 343-2, and a counter 344-2. The various components (including portions thereof) of the CTU 350 of FIGS. 3A and 3B are substantially the same as the corresponding components (including portions thereof) of the CTUs of FIGS. 1 and 2 above.

At the time captured in FIGS. 3A and 3B, the CTU 350 is just set (e.g., assembled off site and transported to the job site) or assembled at the job site. For example, the CTU 350 may be placed on the ground (e.g., ground 208) proximate to entry points (e.g., entry points 192) of multiple wellbores (e.g., wellbores 190) for planned operation of one or more of the tubing reels 310. The tubing reel 310-1 is positioned on one portion of the base 312, and the tubing reel 310-2 is positioned on another portion of the base 312. The two portions of the base 312 on which the tubing reels 310 are positioned may be separated from each other in such a way that allows for the full range of motion of the mobility feature 325 and the operation of one tubing reel 310 (e.g., tubing reel 310-2) without interfering with the full range of motion of the mobility feature 325 and/or the operation of the other tubing reel 310 (e.g., tubing reel 310-1).

At the time captured in FIGS. 3A and 3B, the tubing reel 310-1 and the tubing reel 310-2 are facing away from the control cab 335 and are aligned substantially in parallel with each other along the rotational axis of the spools 320. The tubing reel 310-1 and the tubing reel 310-2 are configured substantially the same as each other (e.g., the spools 320 of the tubing reels 310 are substantially the same size as each other). The mobility features 325 of both tubing reels 310 are locked in place during transportation and/or positioning the CTU 350 on the job site to avoid injury and/or damage to equipment.

The base 312 of the CTU 350 in this case also includes four lifting aids 314 that extend upward from the top surface of the base 312 at the corners. The lifting aids 314 may take any of a number of forms and/or configurations. In this case, all four lifting aids 314 are in the form of eyelifts, which can engage cables from a crane (e.g., a crane 176) or other form of lifting apparatus. In addition, or in the alternative, a lifting aid 314 may take any of a number of other forms, including but not limited to a tunnel along the bottom surface of the base 312 (e.g., for receiving a tine of a fork lift) and a ramp along the side and bottom of the base 312 (e.g., for receiving the scoop of a bulldozer). The base may have any number (e.g., 0, 1, 2, 4, 8, 20) of lifting aids 314.

Figure 4:
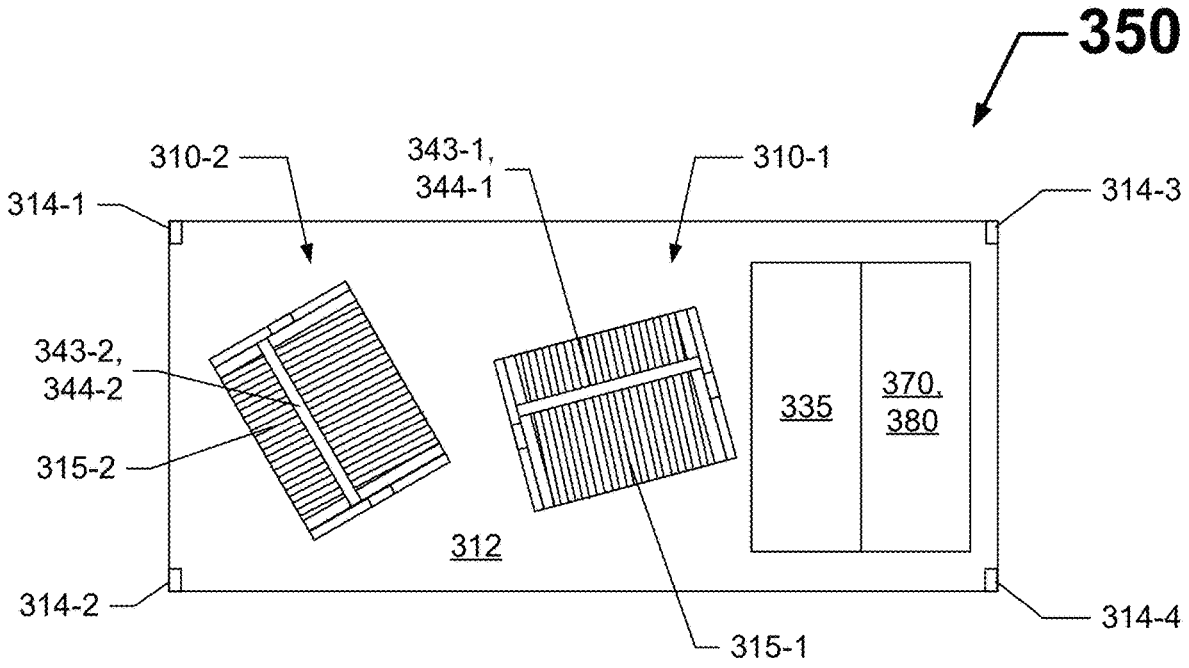
FIG. 4 shows a top view of the CTU of FIGS. 3A and 3B after both tubing reels have been repositioned according to certain example embodiments.
Figure 6:
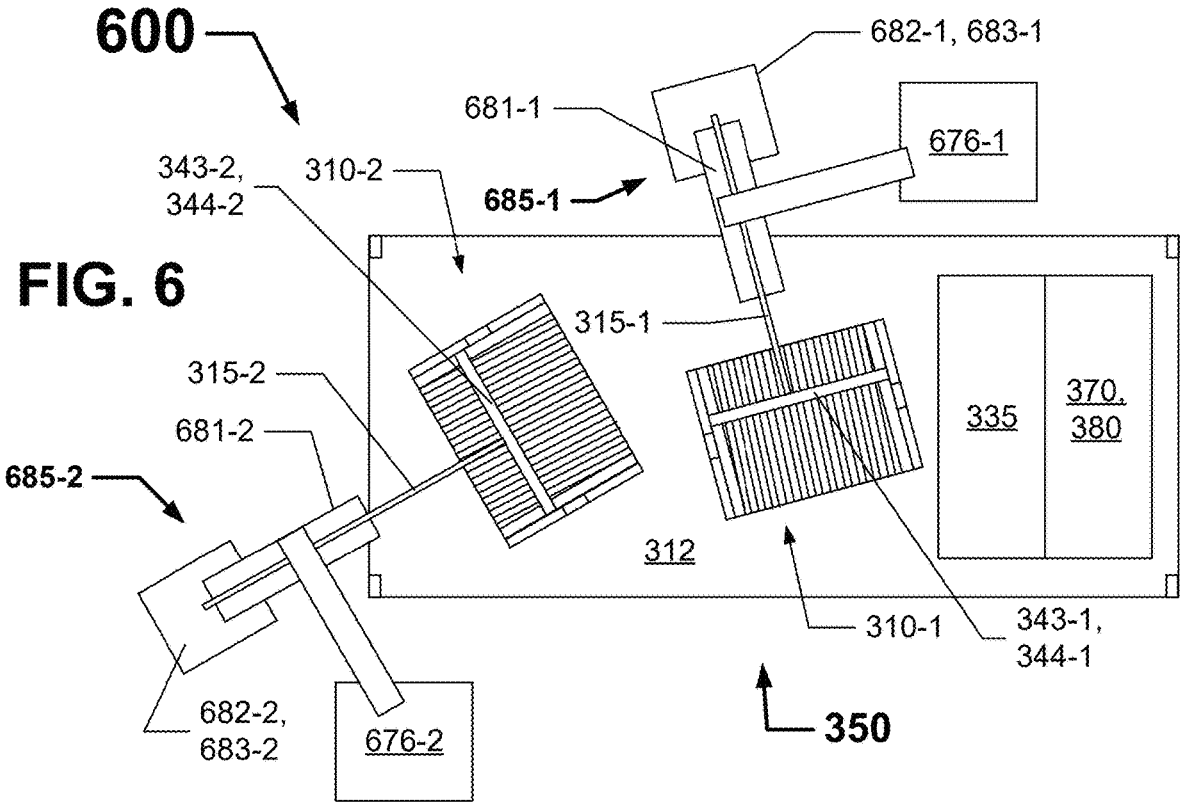
FIG. 6 shows a top view of a system for performing subterranean wellbore operations of two wellbores according to certain example embodiments.
Figure 7:
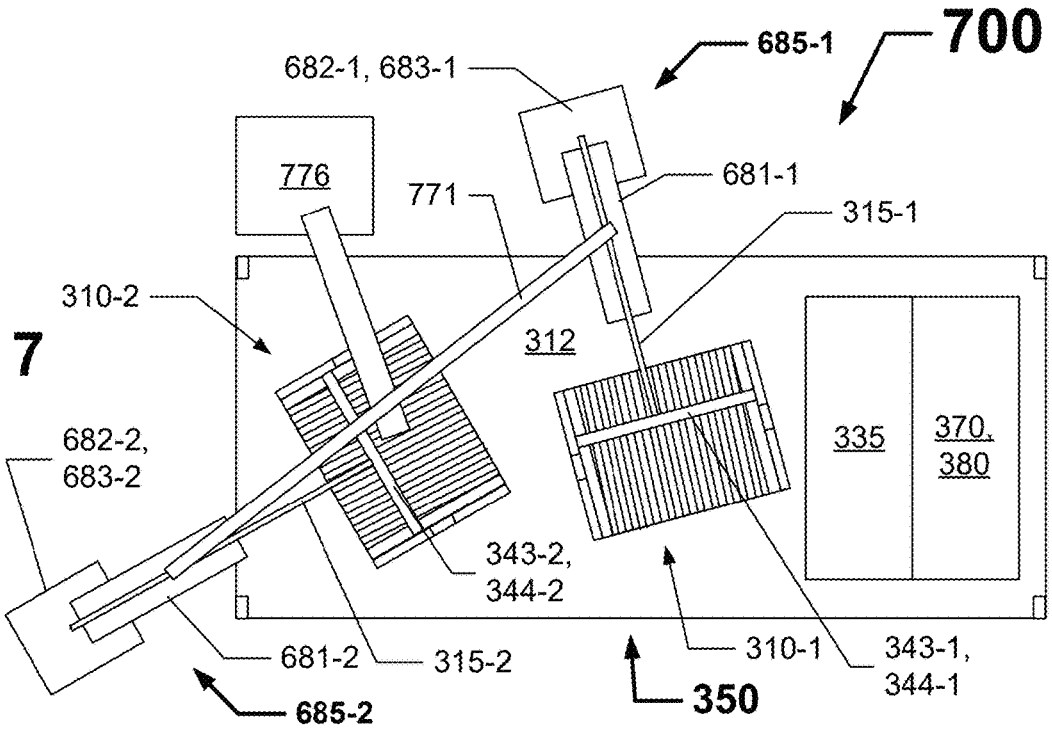
FIG. 7 shows a top view of another system for performing subterranean wellbore operations of two wellbores according to certain example embodiments.

FIG. 4 shows a top view of the CTU 350 of FIGS. 3A and 3B after both tubing reels 310 have been repositioned according to certain example embodiments. Referring to the description above with respect to FIGS. 1 through 3B, the fluid injection system 370, the prime mover 380, the control cab 335, and the four lifting aids 314 (lifting aid 314-1, lifting aid 314-2, lifting aid 314-3, and lifting aid 314-4) maintain their position on the base 312 at the time captured in FIG. 4 relative to the time captured in FIGS. 3A and 3B. However, the position of the tubing reel 310-1 and the tubing reel 310-2 have changed at the time captured in FIG. 4 relative to the time captured in FIGS. 3A and 3B. In this way, as shown in FIGS. 6 and 7 below, each tubing reel 310 can be positioned to simultaneously and independently service separate wellbores (e.g., wellbores 190).

Specifically, the tubing reel 310-1 in FIG. 4 has been rotated clockwise (when viewed from above) by approximately 80° relative to its position in FIG. 3B. The tubing reel 310-1 is rotated using the mobility features 325-1 shown in FIG. 3B and hidden from view in FIG. 4. In this case, when the tubing reel 310-1 is rotated, the spool 320-1, the coiled tubing 315-1, the level wind 343-1, and the counter 344-1 all rotate together because the coiled tubing 315-1 is wrapped around the spool 320-1 and because the level wind 343-1 and the counter 344-1 are attached to the spool 320-1. As discussed above, the mobility feature 325-1 of the tubing reel 310-1 may include a locking mechanism (e.g., a bolt, a clamp, a hydraulic stop) that locks the tubing reel 310-1 into its new position.

A Iso, the tubing reel 310-2 in FIG. 4 has been rotated counterclockwise (when viewed from above) by approximately 35° relative to its position in FIG. 3B. The tubing reel 310-2 is rotated using the mobility features 325-2 shown in FIG. 3B and hidden from view in FIG. 4. In this case, when the tubing reel 310-2 is rotated, the spool 320-2, the coiled tubing 315-2, the level wind 343-2, and the counter 344-2 all rotate together because the coiled tubing 315-2 is wrapped around the spool 320-2 and because the level wind 343-2 and the counter 344-2 are attached to the spool 320-2. As discussed above, the mobility feature 325-2 of the tubing reel 310-2 may include a locking mechanism (e.g., a spring-loaded stop, chucks) that locks the tubing reel 310-2 into its new position.

Figure 5:
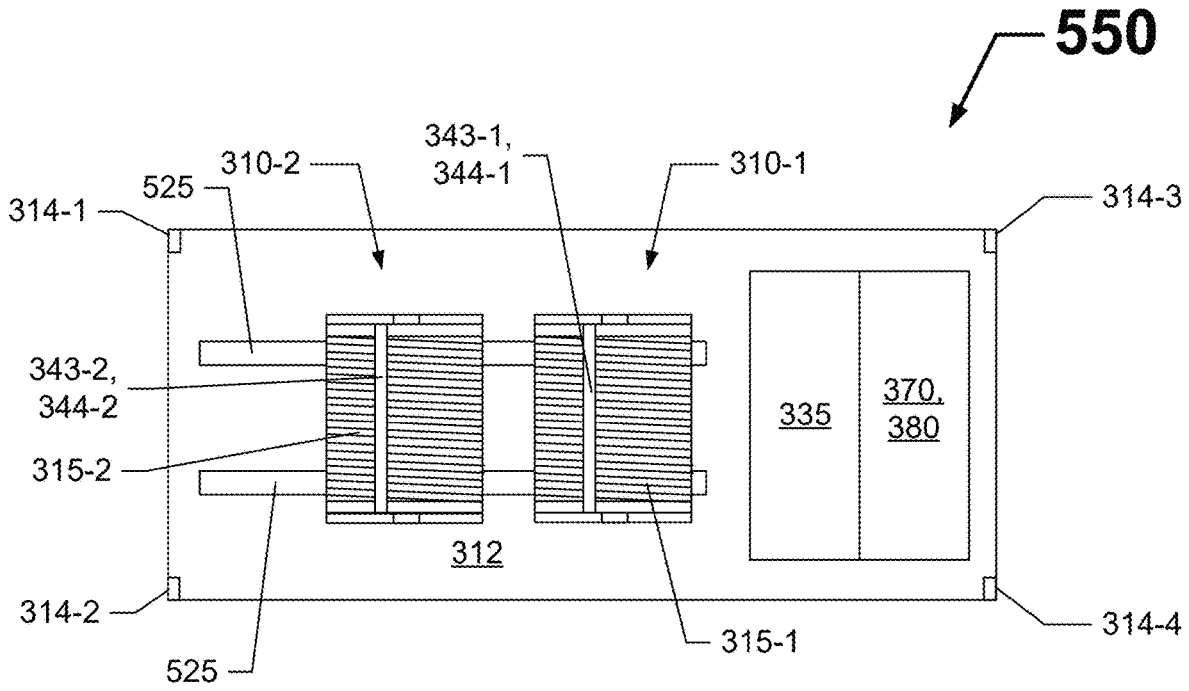
FIG. 5 shows a top view of another CTU according to certain example embodiments.

FIG. 5 shows a top view of another CTU 550 according to certain example embodiments. Referring to the description above with respect to FIGS. 1 through 4, the CTU 550 of FIG. 5 is a variation of the CTU 350 of FIGS. 3A and 3B. Specifically, the CTU 550 of FIG. 5 is identical to the CTU 350 of FIGS. 3A and 3B except for the configuration of the mobility features 525. For example, the CTU 550 of FIG. 5 includes the base 312, the tubing reel 310-1 (including the coiled tubing 315-1, the spool 320-1, the level wind 343-1, and the counter 344-1), the tubing reel 310-2 (including the coiled tubing 315-2, the spool 320-2, the level wind 343-2, and the counter 344-2), the control cab 335, the fluid injection system 370, the prime mover 380, and the four lifting aids 314 (lifting aid 314-1, lifting aid 314-2, lifting aid 314-3, and lifting aid 314-4) of the CTU 350 of FIGS. 3A and 3B. In some cases, the tubing reel 310-1 of FIG. 5 may also include the mobility features 325-1 of FIGS. 3A and 3B, and the tubing reel 310-2 of FIG. 5 may also include the mobility features 325-2 of FIGS. 3A and 3B.

However, the CTU 550 of FIG. 5 also includes a mobility feature 525 in the form of rails mounted atop the base 312. The mobility features 525 allow one or both tubing reels 310 to move (e.g., slidable movement) along part of the length of the base 312. In this example, the tubing reel 310-2 is moved toward tubing reel 310-1 using the mobility features 525, and the tubing reel 310-1 has maintained its position on the base 312 relative to the position shown in FIGS. 3A and 3B. As with the mobility features (e.g., mobility features 325) discussed above, the mobility features 525 may include a locking mechanism that locks one or both tubing reels 310 into any position along the mobility features 525.

FIG. 6 shows a top view of a system 600 for performing subterranean wellbore operations of two wellbores according to certain example embodiments. Referring to the description above with respect to FIGS. 1 through 5, the system 600 of FIG. 6 includes the CTU 350 of FIGS. 3A through 4, two cranes 676 (crane 676-1 and crane 676-2), two guide arches 681 (guide arch 681-1 and guide arch 681-2), two injector heads 682 (injector head 682-1 and injector head 682-2), and two BOPs 683 (BOP 683-1 and BOP 683-2). The CTU 350 of FIG. 6 includes the base 312, the tubing reel 310-1 (including the coiled tubing 315-1, the spool 320-1, the level wind 343-1, and the counter 344-1), the tubing reel 310-2 (including the coiled tubing 315-2, the spool 320-2, the level wind 343-2, and the counter 344-2), the control cab 335, the fluid injection system 370, the prime mover 380, and the four lifting aids (not labeled in FIG. 6 to save space) of the CTU 350 of FIGS. 3A through 4.

At the time captured in FIG. 6, the position of the tubing reel 310-1 and the tubing reel 310-2 with respect to the base 312 matches their position on the base 312 shown in FIG. 4. In this case, the tubing reel 310-1 is positioned to face the guide arch 681-1 so that the coiled tubing 315-1 can be efficiently fed through the injector head 682-1 and the BOP 683-1 to the wellbore (hidden from view in FIG. 6 but substantially similar to the wellbores (e.g., wellbores 190) discussed above). Similarly, the tubing reel 310-2 is positioned to face the guide arch 681-2 so that the coiled tubing 315-2 can be efficiently fed through the injector head 682-2 and the BOP 683-2 to the wellbore (hidden from view in FIG. 6 but substantially similar to the wellbores (e.g., wellbores 190) discussed above). In this case, the coiled tubing 315-1 is inserted into a wellbore (e.g., a wellbore 190) through the assembly 685-1 of the guide arch 681-1, the injector head 682-1, and the BOP 683-1 while the coiled tubing 315-2 is inserted into another wellbore (e.g., a wellbore 190) through the assembly 685-2 of the guide arch 681-2, the injector head 682-2, and the BOP 683-2.

Under the configuration shown in FIG. 6, the fluid injection system 370 can provide one or more fluids to the tubing reel 310-1 and the tubing reel 310-2 independently and/or simultaneously. At any point in time, the fluid provided by the fluid injection system 370 to the tubing reel 310-1 may be the same as, or different than, the fluid provided by the fluid injection system 370 to the tubing reel 310-2. In addition, or in the alternative, at any point in time, the parameters (e.g., flow rate, pressure, temperature) of a fluid provided by the fluid injection system 370 to the tubing reel 310-1 may be the same as, or different than, the corresponding parameters of the fluid provided by the fluid injection system 370 to the tubing reel 310-2.

In addition, or in the alternative, under the configuration shown in FIG. 6, the prime mover 380 can provide power and/or hydraulics to the tubing reel 310-1 and the tubing reel 310-2 independently and/or simultaneously. At any point in time, the level (e.g., 240V, 120V, 24V) and type (e.g., alternating current, direct current) of power provided by the prime mover 380 to the tubing reel 310-1 may be the same as, or different than, the level and type of power provided by the prime mover 380 to the tubing reel 310-2. In some cases, the prime mover 380 may provide more than one level and/or more than one type of power to one or both of the tubing reels 310 at a point in time. In addition, or in the alternative, at any point in time, the level (e.g., in terms of pressure, in terms of amount) of hydraulics provided by the prime mover 380 to the tubing reel 310-1 may be the same as, or different than, the level of hydraulics provided by the prime mover 380 to the tubing reel 310-2.

The control cab 335 may be configured to control the operation of the tubing reel 310-1 and the tubing reel 310-2 independently and simultaneously with respect to each other. Further, any controller (e.g., controllers 104), sensor device (e.g., sensor devices 160), valve, relay, and/or other component of the system 600 may be used for only for the tubing reel 310-1, only for the tubing reel 310-2, for both of the tubing reel 310-1 and the tubing reel 310-2, and/or for some other component (e.g., the prime mover 380, the fluid injection system 370) of the system 600.

FIG. 7 shows a top view of another system 700 for performing subterranean wellbore operations of two wellbores according to certain example embodiments. Referring to the description above with respect to FIGS. 1 through 6, the system 700 of FIG. 7 is substantially the same as the system 600 of FIG. 6, except as described below. For example, the system 700 of FIG. 7 includes the CTU 350 of FIGS. 3A through 4 and 6, the two guide arches 681 (guide arch 681-1 and guide arch 681-2), the two injector heads 682 (injector head 682-1 and injector head 682-2), and the two BOPs 683 (BOP 683-1 and BOP 683-2). The CT U 350 of FIG. 7 includes the base 312, the tubing reel 310-1 (including the coiled tubing 315-1, the spool 320-1, the level wind 343-1, and the counter 344-1), the tubing reel 310-2 (including the coiled tubing 315-2, the spool 320-2, the level wind 343-2, and the counter 344-2), the control cab 335, the fluid injection system 370, the prime mover 380, and the four lifting aids (not labeled in FIG. 7 to save space) of the CTU 350 of FIGS. 3A through 4 and 6.

However, the system 700 of FIG. 7 has only one crane 776 instead of the two cranes 676 with the system 600 of FIG. 6. With the configurability of the tubing reel 310-1 and the tubing reel 310-2 using the mobility features, and with the ability to independently and simultaneously perform subterranean field operations with the tubing reel 310-1 and the tubing reel 310-2, there may be situations, such as what is shown in FIG. 7, where multiple wellbores (e.g., wellbores 190) undergoing separate subterranean field operations at the same time and located proximate to each other and the CTU 350 can have their assemblies 685 of the guide arch 681, the injector head 682, and the BOP 683 suspended by a single crane 776 instead of an individual crane for each assembly (as in FIG. 6). In other words, the crane 776 simultaneously suspends the assembly 685-1 and the assembly 685-2.

In this case, the guide arch 681-1 (as well as the rest of the assembly 685-1 that includes the injector head 682-1 and the BOP 683-1) and the guide arch 681-2 (as well as the rest of the assembly 685-2 that includes the injector head 682-2 and the BOP 683-2) are supported by the crane 776 via a spreader bar 771. Specifically, the crane 776 supports the spreader bar 771 at a point toward the middle of the spreader bar 771, the assembly 685-1 that includes the guide arch 681-1 is supported toward one end of the spreader bar 771, and the assembly 685-2 that includes the guide arch 681-2 is supported toward the opposite end of the spreader bar 771. The spreader bar 771 may be adjustable to help ensure that the assembly 685-1 that includes the guide arch 681-1 and the assembly 685-2 that includes the guide arch 681-2 are substantially evenly supported by the crane 776. In this way, by using only one crane 776 instead of the two used in FIG. 6, money can be saved in rental fees, a safer work environment can be fostered by having fewer large pieces of movable equipment in the same footprint, and fewer people are required during the subterranean field operations of the wellbores.

Figure 8:
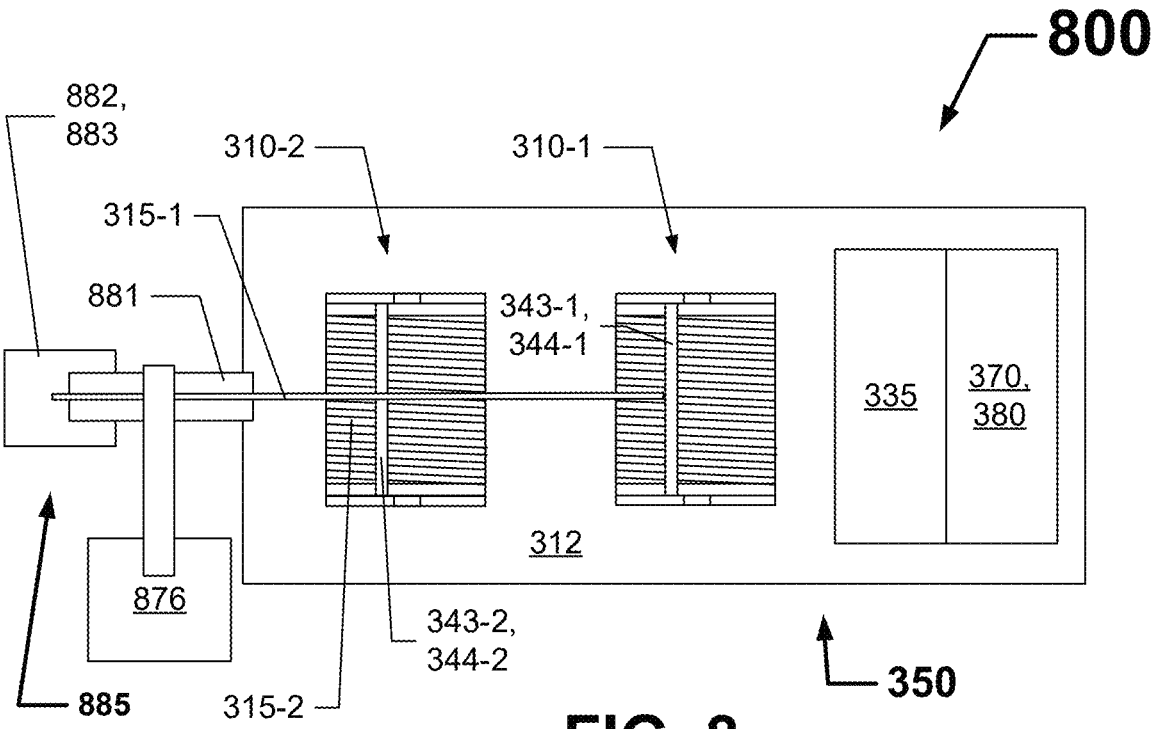
FIG. 8 shows a top view of yet another system for performing subterranean wellbore operations of one wellbore according to certain example embodiments.

FIG. 8 shows a top view of yet another system 800 for performing subterranean wellbore operations of one wellbore according to certain example embodiments. Referring to the description above with respect to FIGS. 1 through 7, the system 800 of FIG. 8 includes CTU 350 that is substantially the same as the CTU of FIGS. 3A and 3B. For example, the CTU 350 of FIG. 8 includes the base 312, the tubing reel 310-1 (including the coiled tubing 315-1, the spool 320-1, the level wind 343-1, and the counter 344-1), the tubing reel 310-2 (including the coiled tubing 315-2, the spool 320-2, the level wind 343-2, and the counter 344-2), the control cab 335, the fluid injection system 370, the prime mover 380, and the four lifting aids (not labeled in FIG. 8 to save space) of the CTU 350 of FIGS. 3A and 3B.

In addition to the CTU 350, the system 800 of FIG. 8 includes a guide arch 881, an injector head 882, a BOP 883, and a crane 876. In this case, the wellbore (e.g., wellbore 190) being serviced is hidden from view by the assembly 885 of the guide arch 881, the injector head 882, and the BOP 883. The crane 876 is used to support the assembly 885 of the guide arch 881, the injector head 882, and the BOP 883 and maintain its position relative to the wellbore and the CTU 350. At the point in time captured in FIG. 8, the tubing reel 310-2 is idle while the tubing reel 310-1 is in service, feeding the coiled tubing 315-1 into the wellbore through the assembly 885 of the guide arch 881, the injector head 882, and the BOP 883. The orientation of the tubing reel 310-1 and the tubing reel 310-2 are in parallel with each other, substantially aligned to face the wellbore. This mode of operation for the CTU 350 continues until the coiled tubing 315-1 runs out (is inserted into the wellbore), as shown in FIG. 9 below.

Figure 9:
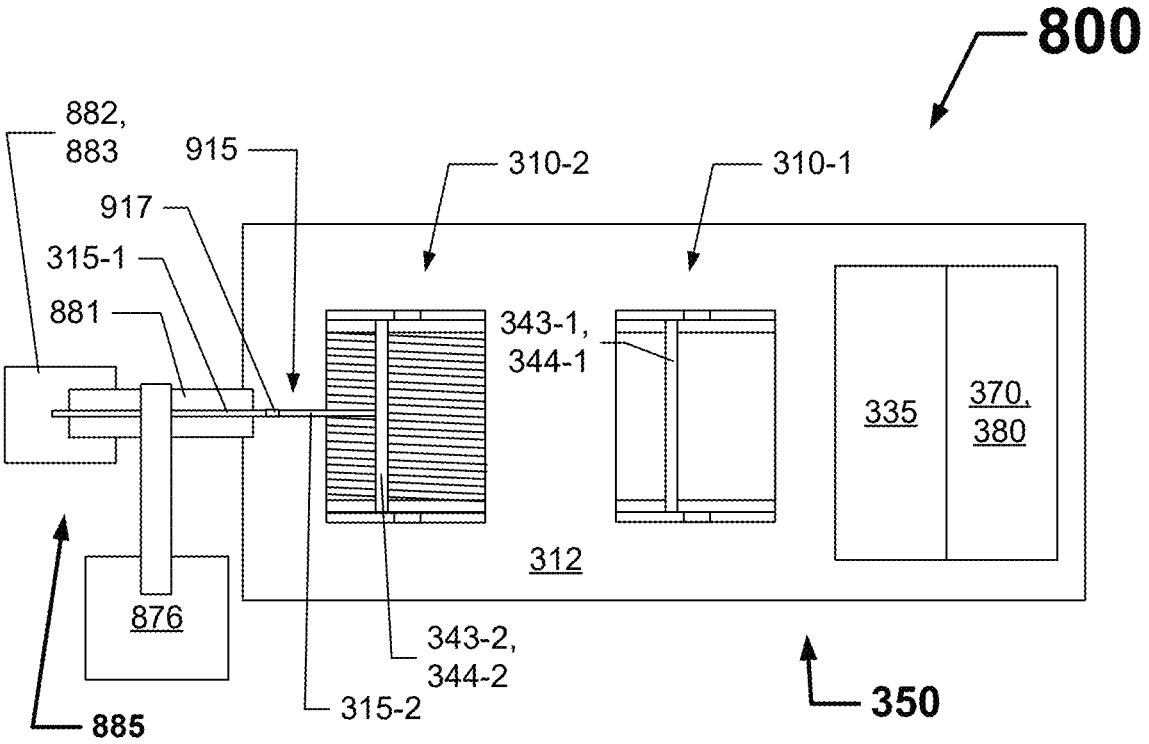
FIG. 9 shows a top view of the system of FIG. 8 for performing subterranean wellbore operations of one wellbore at a subsequent point in time according to certain example embodiments.

FIG. 9 shows a top view of the system 800 of FIG. 8 for performing subterranean wellbore operations of one wellbore at a subsequent point in time according to certain example embodiments. Referring to the description above with respect to FIGS. 1 through 8, the system 800 of FIG. 9 shows when the coiled tubing 315-1 of the tubing reel 310-1 has run out. In this case, the proximal end of the coiled tubing 315-2 of the tubing reel 310-2, previously idle, is spliced to the distal end of the coiled tubing 315-1 of the tubing reel 310-1. When this occurs, the coiled tubing 315-1 and the coiled tubing 315-2 form a continuous coiled tubing 315 for continued insertion into the wellbore. In this way, example embodiments can allow for splicing multiple coiled tubings 315 together to form an elongated coiled tubing with minimal down time, avoiding the need to remove the empty tubing reel 310 from the CTU 350 and load a full tubing reel 310 on the base 312, as is required in the current art.

Example embodiments can be used to improve the efficiency of performing subterranean field operations on wellbores using CTUs. Specifically, example embodiments can be used to effectively, independently, and simultaneously conduct subterranean field operations on multiple wellbores using a single CTU. In addition, or in the alternative, example embodiments can be used to insert an elongated coiled tubing into a wellbore with minimal down time. Example embodiments allow for shared equipment and resources, reduced manpower requirements, and reduced space requirements. Example embodiments can also provide a number of other benefits. Such other benefits can include, but are not limited to, less use of resources, greater operational flexibility, time savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A coiled tubing unit (CTU) for performing subterranean wellbore operations, the CTU comprising: a base that is placeable within a pad; a first tubing reel positioned on a first portion of the base, wherein the first tubing reel comprises a first spool and a first coiled tubing, wherein the first tubing reel is aligned with a first assembly above a first entry point of a first wellbore within the pad, wherein the first assembly comprises a first guide arch, and wherein the first spool is configured to rotate in order to move the first coiled tubing through the first guide arch within the first wellbore within a subterranean formation; and a second tubing reel positioned on a second portion of the base, wherein the second tubing reel comprises a second spool and a second coiled tubing, wherein the second tubing reel is movable with respect to the base and the first tubing reel and is aligned with a second assembly above a second entry point of a second wellbore within the pad, wherein the second assembly comprises a second guide arch, and wherein the second spool is configured to rotate in order to move the second coiled tubing through the second guide arch within the second wellbore within the subterranean formation, and wherein the first tubing reel and the second tubing reel are configured to be operated simultaneously and independently of each other.

2. The CTU of claim 1, wherein the first spool of the first tubing reel is movably coupled to the base.

3. The CTU of claim 2, wherein the first spool is rotatable about a vertical axis with respect to the base.

4. The CTU of claim 2, wherein the first spool is slidable along the first portion of the base.

5. The CTU of claim 1, wherein the second coiled tubing has a proximal end that is configured to splice with a distal end of the first coiled tubing so that the first coiled tubing and the second coiled tubing form a continuous coiled tubing for insertion into the wellbore.

6. The CTU of claim 1, wherein the second coiled tubing is configured to be inserted into a second wellbore while the first coiled tubing is inserted into the wellbore.

7. The CTU of claim 1, further comprising:

a fluid injection system that is configured to provide a fluid that flows through the first coiled tubing into the wellbore.

8. The CTU of claim 7, wherein the fluid injection system is further configured to provide the fluid that flows through the second coiled tubing.

9. The CTU of claim 7, further comprising:

a second fluid injection system that is configured to provide a second fluid that flows through the second coiled tubing into a second wellbore adjacent to the wellbore.

10. The CTU of claim 1, wherein the base is configured to be transported on a trailer of a truck.

11. The CTU of claim 10, wherein the first tubing reel and the second tubing reel are configured to be operated while the base is on the trailer as the truck is located within the pad.

12. The CTU of claim 1, wherein the base is part of a skid that is placed within the pad on ground proximate to entry points of the wellbore and a second wellbore during operation of at least one of the first tubing reel and the second tubing reel.

13. The CTU of claim 12, wherein the skid comprises a lifting aid that is configured to engage a lifting apparatus that allows the skid to be moved.

14. The CTU of claim 1, further comprising:

a control cab mounted on the base, wherein the control cab allows a user to control operation of at least one of the first tubing reel and the second tubing reel at a point in time.

15. The CTU of claim 1, further comprising:

a first level wind and a first counter that are configured to assist winding and unwinding the first coiled tubing with respect to the first spool; and a second level wind and a second counter that are configured to assist winding and unwinding the second coiled tubing with respect to the second spool.

16. The CTU of claim 1, wherein the first tubing reel and the second tubing reel operate using power and hydraulics provided by a prime mover.

17. The CTU of claim 16, wherein the prime mover is located on the base.

18. A coiled tubing system comprising:

a first guide arch positioned adjacent to a first entry point of a first wellbore;

a second guide arch positioned adjacent to a second entry point of a second wellbore; and a coiled tubing unit (CTU) positioned proximate to the first guide arch and the second guide arch, wherein the CTU comprises:

a base;

a first tubing reel positioned on a first portion of the base, wherein the first tubing reel comprises a first spool and a first coiled tubing, wherein the first tubing reel is aligned with the first guide arch, and wherein the first spool is configured to rotate about a first horizontal axis in order to move the first coiled tubing through the first guide arch within the first wellbore within a subterranean formation; and a second tubing reel positioned on a second portion of the base, wherein the second tubing reel comprises a second spool and a second coiled tubing, wherein the second tubing reel is rotatable about a vertical axis independent of the base and the first tubing reel in order to align the second tubing reel with the second guide arch, and wherein the second spool is configured to rotate about a second horizontal axis in order to move the second coiled tubing through the second guide arch within the second wellbore within the subterranean formation, and wherein the first tubing reel and the second tubing reel are configured to be operated simultaneously and independently of each other.

19. The coiled tubing system of claim 18, wherein the first guide arch and the second guide arch are supported by a crane via a spreader bar.

20. The coiled tubing system of claim 18, further comprising:

a downhole fluid processing system that is configured to receive and process a first downhole fluid from the first wellbore and a second downhole fluid from the second wellbore.

* * * * *